US007079131B2

(12) United States Patent
LeChevalier

(10) Patent No.: US 7,079,131 B2
(45) Date of Patent: Jul. 18, 2006

(54) APPARATUS FOR PERIODIC ELEMENT VOLTAGE SENSING TO CONTROL PRECHARGE

(75) Inventor: Robert LeChevalier, Golden, CO (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 625 days.

(21) Appl. No.: 10/141,648

(22) Filed: May 7, 2002

(65) Prior Publication Data

US 2002/0167478 A1 Nov. 14, 2002

Related U.S. Application Data

(60) Provisional application No. 60/353,753, filed on Oct. 19, 2001, provisional application No. 60/346,102, filed on Oct. 19, 2001, provisional application No. 60/343,856, filed on Oct. 19, 2001, provisional application No. 60/343,638, filed on Oct. 19, 2001, provisional application No. 60/343,370, filed on Oct. 19, 2001, provisional application No. 60/342,794, filed on Oct. 19, 2001, provisional application No. 60/342,793, filed on Oct. 19, 2001, provisional application No. 60/342,791, filed on Oct. 19, 2001, provisional application No. 60/342,783, filed on Oct. 19, 2001, provisional application No. 60/342,637, filed on Oct. 19, 2001, provisional application No. 60/342,582, filed on Oct. 19, 2001, provisional application No. 60/289,724, filed on May 9, 2001.

(51) Int. Cl.
*G09G 5/00* (2006.01)

(52) U.S. Cl. ..... 345/215; 345/204

(58) Field of Classification Search ..... 345/55, 345/87, 204–206, 76, 77, 80, 82, 214–215; 371/214; 315/169.1–169.4
See application file for complete search history.

(56) References Cited

U.S. PATENT DOCUMENTS

| | | | | |
|---|---|---|---|---|
| 4,236,199 | A | 11/1980 | Stewart | |
| 4,366,504 | A | 12/1982 | Kanatani | |
| 4,603,269 | A | 7/1986 | Hochstein | |
| RE32,526 | E | 10/1987 | Hochstein | |
| 4,823,121 | A | 4/1989 | Sakamoto et al. | |
| 5,117,426 | A * | 5/1992 | McAdams | 714/721 |
| 5,162,688 | A | 11/1992 | Bouton | |
| 5,514,995 | A | 5/1996 | Hennig | |
| 5,519,712 | A * | 5/1996 | Shu et al. | 365/201 |
| 5,594,463 | A | 1/1997 | Sakamoto | |
| 5,606,527 | A * | 2/1997 | Kwack et al. | 365/201 |

(Continued)

FOREIGN PATENT DOCUMENTS

EP 1 071 070 A3 6/1992

(Continued)

OTHER PUBLICATIONS

International Search Report dated Nov. 28, 2003 for International Application No. PCT/US02/14686, filed May 7, 2002.

(Continued)

*Primary Examiner*—Sumati Lefkowitz
*Assistant Examiner*—Alecia D. Nelson
(74) *Attorney, Agent, or Firm*—Knobbe, Martens, Olson & Bear, LLP

(57) ABSTRACT

An apparatus to determine and apply a voltage to precharge current-driven elements in a matrix. During ordinary scan cycles, a conduction voltage is sensed while the elements conduct a selected current. While not conducting the selected current, the sensed conduction voltage is averaged with other conduction voltages, and based on the averaged voltage a precharge voltage is provided during a precharge period of the scan cycle.

27 Claims, 4 Drawing Sheets

U.S. PATENT DOCUMENTS

| | | | | | |
|---|---|---|---|---|---|
| 5,672,992 | A | | 9/1997 | Nadd | |
| 5,686,936 | A | | 11/1997 | Maekawa et al. | |
| 5,689,208 | A | | 11/1997 | Nadd | |
| 5,708,454 | A | * | 1/1998 | Katoh et al. | 345/100 |
| 5,764,207 | A | | 6/1998 | Maekawa et al. | |
| 5,818,268 | A | * | 10/1998 | Kim et al. | 327/77 |
| 5,844,368 | A | | 12/1998 | Okuda et al. | |
| 5,949,194 | A | | 9/1999 | Kawakami et al. | |
| 5,952,789 | A | | 9/1999 | Stewart et al. | |
| 5,982,205 | A | * | 11/1999 | Vallancourt | 327/94 |
| 6,020,769 | A | * | 2/2000 | Vallancourt | 327/94 |
| 6,067,061 | A | | 5/2000 | Friedman | |
| 6,075,739 | A | * | 6/2000 | Ihara | 365/222 |
| 6,181,314 | B1 | | 1/2001 | Nakajima et al. | |
| 6,191,534 | B1 | | 2/2001 | Schuler et al. | |
| 6,201,717 | B1 | | 3/2001 | Grant | |
| 6,229,508 | B1 | | 5/2001 | Kane | |
| 6,313,819 | B1 | | 11/2001 | Maekawa et al. | |
| 6,366,116 | B1 | | 4/2002 | Juang | |
| 6,433,488 | B1 | | 8/2002 | Bu | |
| 6,448,948 | B1 | | 9/2002 | Friedman | |
| 6,473,064 | B1 | | 10/2002 | Tsuchida et al. | |
| 6,489,631 | B1 | | 12/2002 | Young et al. | |
| 6,583,775 | B1 | | 6/2003 | Sekiya et al. | |
| 6,584,589 | B1 | * | 6/2003 | Perner et al. | 714/721 |
| 6,594,606 | B1 | | 7/2003 | Everitt | |
| 6,633,135 | B1 | | 10/2003 | Nara et al. | |
| 6,650,308 | B1 | | 11/2003 | Kawashima | |
| 6,661,401 | B1 | | 12/2003 | Sekine | |
| 6,714,177 | B1 | | 3/2004 | Ishizuka | |
| 6,859,193 | B1 | | 2/2005 | Yumoto | |
| 2001/0024186 | A1 | | 9/2001 | Kane et al. | |

FOREIGN PATENT DOCUMENTS

| | | | |
|---|---|---|---|
| EP | 0 678 849 | A1 | 10/1995 |
| EP | 1 071 070 | A2 | 1/2001 |
| EP | 1 081 836 | A2 | 3/2001 |
| GB | 2 337 354 | A | 11/1999 |
| GB | 2 339 638 | A | 2/2000 |
| JP | 07-199861 | | 6/1984 |
| JP | 59-97223 | | 6/1984 |
| JP | 4-172963 | | 6/1992 |
| JP | 7-322605 | | 12/1995 |
| JP | 11-330376 | | 11/1999 |
| WO | WO 01/27910 | A1 | 4/2001 |

OTHER PUBLICATIONS

International Search Report dated Apr. 8, 2004 for International Application No. PCT/US02/33373.

International Search Report dated Apr. 8, 2004 for International Application No. PCT/US02/33373.

International Search Report dated Jun. 26, 2003 for International Application No. PCT/US02/33364, filed Oct. 17, 2002.

International Search Report dated Jun. 26, 2003 for International Application No. PCT/US02/33428, filed Oct. 17, 2002.

International Search Report dated Jun. 26, 2003 for International Application No. PCT/US02/33519, filed Oct. 17, 2002.

International Search Report dated Nov. 27, 2003 for International Application No. PCT/US02/14699, filed Nov. 7, 2002.

International Search Report for International Application No. PCT/US02/33375, filed Oct. 17, 2002, dated Jun. 23, 2003.

International Search Report for International Application No. PCT/US02/33426, filed Oct. 17, 2002, dated Jun. 23, 2003.

International Search Report for International Application No. PCT/US02/33574, filed Oct. 17, 2002, dated Jun. 23, 2003.

Office Action dated Mar. 24, 2004 from appln. No. 10/141,318 and claims from the respective appln.

Office Action dated Nov. 17, 2004 from appln. No. 10/141,318 and claims from the respective appln.

* cited by examiner

APPARATUS FOR PERIODIC ELEMENT VOLTAGE SENSING TO CONTROL PRECHARGE

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/289,724, filed on May 9, 2001, entitled PERIODIC ELEMENT VOLTAGE SENSING FOR PRECHARGE;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001, entitled METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 10/141,650, filed on Oct. 19, 2001, entitled PRECHARGE VOLTAGE CONTROL VIA EXPOSURE VOLTAGE RAMP;

This application is related to, and hereby incorporates by reference, the following pa tent applications:

U.S. patent application Ser. No. 10/141,325 entitled "SYSTEM FOR CURRENT BALANCING IN VISUAL DISPLAY DEVICES", filed on May 7, 2002;

U.S. patent application Ser. No. 10/141,325 entitled "METHOD OF CURRENT BALANCING IN VISUAL DISPLAY DEVICES", filed on May 7, 2002;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141,659 entitled "SYSTEM FOR CURRENT MATCHING IN INTEGRATED CIRCUITS", filed on May 7, 2002;

U.S. patent application Ser. No. 10/141,326 entitled "METHOD OF CURRENT MATCHING IN INTEGRATED CIRCUITS", filed on May 7, 2002;

U.S. patent application Ser. No. 09/852,060, filed May 9, 2001, entitled "MATRIX ELEMENT VOLTAGE SENSING FOR PRECHARGE";

U.S. application Ser. No. 10/141,454 entitled "METHOD OF SENSING VOLTAGE FOR PRECHARGE", filed on even date herewith;

U.S. patent application Ser. No. 10/141,454 entitled "METHOD FOR PERIODIC ELEMENT VOLTAGE SENSING TO CONTROL PRECHARGE", filed on May 7, 2002;

U.S. patent application Ser. No. 10/029,563, filed Dec. 20, 2001, entitled "METHOD OF PROVIDING PULSE AMPLITUDE MODULATION FOR OLED DISPLAY DRIVERS"; and U.S. patent application Ser. No. 10/029,605, filed Dec. 20, 2001, entitled "SYSTEM FOR PROVIDING PULSE AMPLITUDE MODULATION FOR OLED DISPLAY DRIVERS".

FIELD OF THE INVENTION

This invention generally relates to electrical drivers for a matrix of current driven devices, and more particularly to methods and apparatus for determining and providing a precharge for such devices.

DESCRIPTION OF THE RELATED ART

There is a great deal of interest in "flat panel" video displays, particularly for small to midsized displays, such as may be used in laptop computers, cell phones, and personal digital assistants.

Liquid crystal displays (LCDs) are a well-known example of such flat panel video displays, and employ a matrix of "pixels" which selectably block or transmit light. LCDs do not provide their own light; rather, the light is provided from an independent source. Moreover, LCDs are operated by an applied voltage, rather than by current. Luminescent displays are an alternative to LCD displays. Luminescent displays produce their own light, and hence do not require an independent light source. They typically include a matrix of elements, which luminesce when excited by current flow. A common luminescent device for such displays is a light emitting diode (LED).

LED arrays produce light in response to current flowing through the individual elements of the array. The current flow may be induced by either a voltage source or a current source applied to the array elements. A display matrix may use a current drive circuit which accepts analog intensity inputs for each pixel, and varies the drive current of each pixel accordingly to achieve corresponding variation in the brightness of each pixel. This approach produces a different voltage on each element depending on drive current, and requires a charge-and-hold capacitor and operational amplifier for each current source, and does not provide any means to quickly achieve a proper operating voltage in the presence of capacitance related to the element.

A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, OLEDs are current driven devices; however, like LCDs, OLEDs may be arranged in a 2 dimensional array (matrix) of elements to form a video display.

OLED displays can be either passive-matrix or active-matrix. Active-matrix OLED displays use current control circuits integrated with the display itself, with one control circuit corresponding to each individual element on the substrate, to create high-resolution color graphics with a high refresh rate. Passive-matrix OLED displays, on the other hand, are easier to build than active-matrix displays, because the current control and other drive circuitry are implemented external to the display. This allows the display manufacturing process to be significantly simplified.

FIGS. 1A and 1B show a typical physical structure of a passive-matrix display of OLEDs. A layer 110 having a representative series of rows, such as parallel conductors 111–118, is disposed on one side of a sheet of light emitting polymer, or other emissive material, 120. A representative series of columns are shown as parallel transparent conductors 131–138, which are disposed on the other side of sheet 120, adjacent to a glass plate 140. A display cross-section 100 shows a drive voltage V applied between a row 111 and a column 134. A portion of the sheet 120 disposed between the row 111 and the column 134 forms an element 150, which behaves like an LED. The potential developed across this LED causes current flow, so the LED emits light 170. Column conductors are typically transparent because the emitted light 170 must pass through the column conductor 134. Most transparent conductors have relatively high resistance compared with the row conductors 111–118, which may be formed from opaque materials having a low resistivity, such as copper.

This structure results in a matrix of devices, one device formed at each point where a row overlies a column. There will generally be M×N devices in a matrix having M rows and N columns. Typical devices function like light emitting diodes (LEDs), which conduct current and luminesce when voltage of one polarity is imposed across them, and block current when voltage of the opposite polarity is applied.

Each row, and each column, is connected to a number of devices, but exactly one device is common to both a particular row and a particular column. To control these individual LED devices located at the matrix junctions, it is useful to have two distinct driver circuits, one to drive the columns and one to drive the rows. It is conventional to sequentially scan the rows (conventionally connected to device cathodes) with a passive driver switch to a known voltage such as ground, and to provide another driver, which may be a current source, to drive the columns (which are conventionally connected to device anodes).

A parallel plate capacitor is defined by the configuration of sandwiching a non-conductive layer between conductive layers. In the display matrix, the column conductors represent one conductive layer and the row conductors represent an opposing conductive layer. As may be appreciated, a parallel plate capacitor exists at each element, where a column conductor overlays a row conductor. The parasitic capacitance created by the display structure creates an impediment to instantaneous voltage changes on either a row or a column.

A luminescent device matrix and drive system may mitigate effects of parasitic capacitances by resetting each element between scans by applying either ground or Vcc (10V) to both sides of each element at the end of each exposure period. Scanning a row may be initiated by connecting all unscanned rows to Vcc, and grounding the scanned row. An element being driven by a selected column line is therefore provided current from the parasitic capacitance of each element of the column line that is attached to an unscanned row. This procedure may consume excessive power, which can be particularly important in portable devices. A luminescent device matrix configured as such does not have any means to establish the correct voltage and current for a selected element at the moment of turn-on. In many applications the voltage and current required for display elements will change from time to time, and present luminescent device matrices fail to provide any means to compensate for emission characteristics which will vary as the devices age. Thus, what is needed is a means to determine and apply the correct voltage and current at the beginning of scans of current-driven devices in an array.

SUMMARY OF THE INVENTION

In response to the needs discussed above, an apparatus is presented for monitoring display conduction voltages, and on the basis of at least the monitored voltages, determining a precharge voltage.

In one aspect the invention is a precharge device for a display. The precharge device includes a sampling circuit used to sample a conduction voltage of an element of the display. The precharge device also includes a hold circuit that is electrically coupled to the sampling circuit. The hold circuit stores the sampled conduction voltage value and generates a precharge voltage based at least in part on the sampled conduction voltage. The precharge device also includes a buffer that is electrically coupled to the hold circuit. The buffer is used as an output device to provide the precharge voltage output.

In another aspect, the invention is an apparatus for driving current in a display device having at least one display element. In this aspect it includes two drivers, the first being a current driver circuit, connected to a first terminal of the element, which provides a first current, and the second driver connecting a second terminal of the element to a source which will accept the current from the current source. It also includes a precharge output circuit which can output a precharge voltage to the display element, and a voltage sensing circuit configured to store a display conduction voltage developed when the display element conducts a predetermined current, and a precharge control circuit for establishing the precharge voltage based upon the sensed element conduction voltage combined with other display element conduction voltages.

During normal operation the combined stored conduction voltages Vcs may be buffered and provided to the columns of a precharge group during a precharge period at the beginning of each scan cycle. After the precharge period, the channel output currents may be delivered to the individual channels in a conventional manner. At the end of the scan cycle, the individual columns may be shorted to ground to terminate the element's exposure time.

In another aspect, the invention is a precharge level determination circuit for display elements. The circuit includes a current source used to provide a known current to a selected display element. The circuit also includes a sample circuit configured to sample a display conduction voltage during a current conduction period and a sample combining circuit configured to combine the sampled conduction voltage with a combined display conduction voltage. The circuit also includes a precharge level setting circuit configured to set a precharge voltage level based on the combined display conduction voltage.

In another aspect, the invention is a display matrix having element precharge. The display matrix includes a sheet of emissive material having a number of row conductors disposed on a first side of the sheet and a number of column conductors disposed on a second side. The row and column conductors are thus placed on opposite sides of the emissive material. The display matrix also includes a column driver having a drive circuit for each of the column conductors and a row driver having a plurality of switches used to electrically couple each of the row conductors to a first or second voltage potential. The display matrix also includes a precharge device to effect the element precharge. The precharge device includes a sample circuit used to sample conduction voltages on the columns, a hold circuit used to store the sampled conduction voltage values and to generate a precharge voltage based at least in part in the stored voltage, and a buffer used to apply the precharge voltage to the column connector.

DETAILED DESCRIPTION

It may be appreciated that there is a need for a precharge process to reduce the substantial errors in OLED current, which may result from employing a current drive for rapid scanning of OLED devices in a matrix having a large parasitic capacitance. Moreover, since the voltage for an OLED varies substantially with temperature, process, and display aging, a need may also be appreciated to monitor the "on" voltage of the OLEDs and change the precharge process accordingly.

The following detailed description is directed to certain specific embodiments of the invention. The following embodiments overcome obstacles to accurate generation of a desired amount of light output from an LED display, particularly in view of impediments which are rather pronounced in OLEDs, such as relatively high parasitic capacitances, and forward voltages which vary with time and temperature. However, the invention can be embodied in a multitude of different ways. The invention is more general than the embodiments, which are explicitly described, and is not limited by the specific embodiments but rather is defined by the appended claims. In particular, the skilled person will understand that the invention is applicable to any matrix of current-driven devices to enhance the accuracy of the delivered current.

Figure 2:
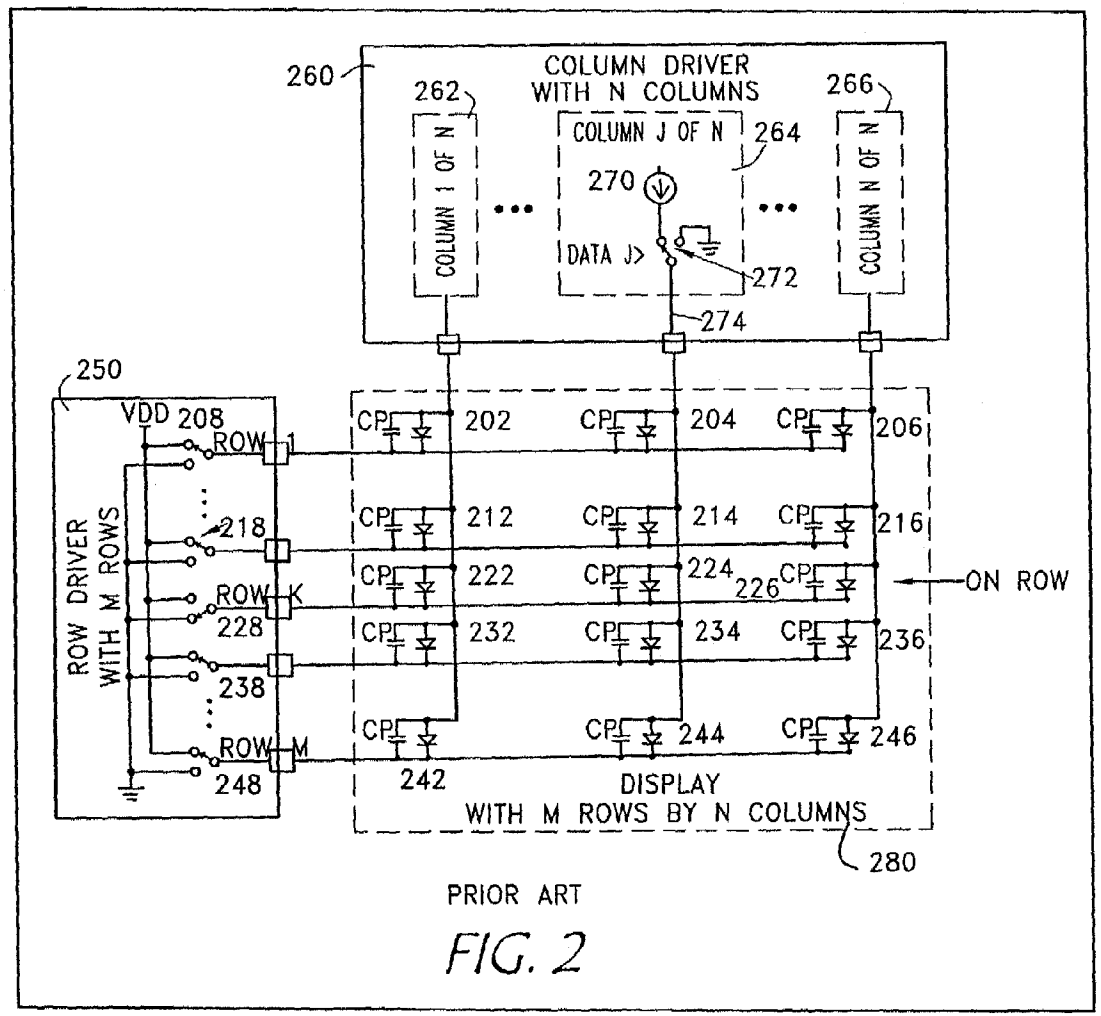
PRIOR ART FIG. 2
FIG. 2 is a simplified schematic diagram of an OLED display with column drivers and row drivers.

FIG. 2 represents such a conventional arrangement for driving a display having M rows and N columns. The display 280 may be described as having first and second terminal regions for connecting to the respective driver circuits. A column driver device 260 includes one column drive circuit, e.g., 262, 264, 266, for each column. The column driver 260 is a first current driver connected to a first terminal region of the display element. The column driver circuit 264 shows some of the details which are typically provided in each column driver. The features within the column driver device 260 include a current source 270 and a switch 272 to enable a column connection 274 to be connected to either the current source 270, to illuminate the selected diode, or to ground, to turn off the selected diode. The row driver 250 is a second driver circuit configured to connect the second terminal region to a known voltage source. A row driver device 250 includes representations of row driver switches (208, 218, 228, 238 and 248). A luminescent display 280 represents a display having M rows and N columns, though only five representative rows and three representative columns are drawn.

Figure 1B:
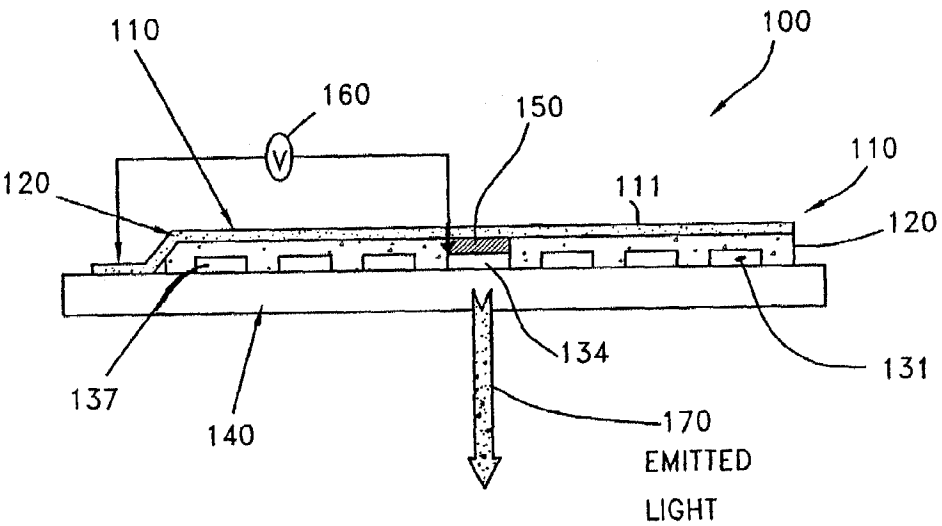
PRIOR ART FIG. 1B
FIG. 1B is a cross-sectional view of the OLED display of FIG. 1A.
Figure 1A:
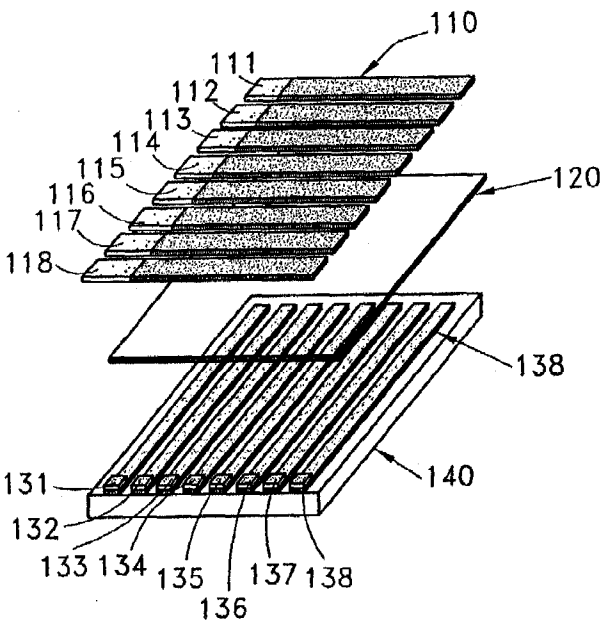
PRIOR ART FIG. 1A
FIG. 1A is a simplified exploded view of an OLED display.

The rows of FIG. 2 are typically a series of parallel connection lines traversing the back of a polymer, organic or other luminescent sheet, and the columns are a second series of connection lines perpendicular to the rows and traversing the front of such sheet, as shown in FIG. 1A. Luminescent elements are established at each region where a row and a column overlie each other so as to form connections on either side of the element. FIG. 2 represents each element as including both an LED aspect (indicated by a diode schematic symbol) and a parasitic capacitor aspect (indicated by a capacitor symbol labeled "CP").

In operation, information is transferred to the matrix display by scanning each row in sequence. During each row scan period, each column connected to an element intended to emit light is also driven. For example, in FIG. 2 a row switch 228 grounds the row to which the cathodes of elements 222, 224 and 226 are connected during a scan of Row K. The column driver switch 272 connects the column connection 274 to the current source 270, such that the element 224 is provided with current. Each of the other columns 1 to N may also be providing current to the respective elements connected to Row K at this time, such as the elements 222 or 226. All current sources are typically at the same amplitude. OLED element light output is controlled by controlling the amount of time the current source for the particular column is on. When an OLED element has completed outputting light, its anode is pulled to ground to turn off the element. At the end of the scan period allowed for Row K, the row switch 228 will typically disconnect Row K from ground and apply Vdd instead. Then, the scan of the next row will begin, with row switch 238 connecting the row to ground, and the appropriate column drivers supplying current to the desired elements, e.g., 232, 234 and/or 236.

Only one element, e.g., element 224, of a particular column, e.g., column J is connected to each row, e.g., Row K, and hence only that element of the column is connected to both the particular column drive (264) and row drive (228) so as to conduct current and luminesce (or be "exposed") during the scan of that row. However, each of the other devices on that particular column, e.g., elements 204, 214, 234 and 244 as shown, but typically including many other devices, are connected by the driver for their respective row (208, 218, 238 and 248 respectively) to a voltage source, Vdd. Therefore, the parasitic capacitance of each of the devices of the column is effectively in parallel with, or added to, the capacitance of the element being driven. The combined parasitic capacitance of the column limits the slew rate of a current drive such as drive 270 of column J. Nonetheless, rapid driving of the elements is necessary. All rows must be scanned many times per second to obtain a reasonable visual appearance, which permits very little time for conduction for each row. Low slew rates may cause large exposure errors for short exposure periods. Thus, for practical implementations of display drivers using the prior art scheme, the parasitic capacitance of the columns may be a severe limitation on drive accuracy.

As an example, each frame constitutes the consecutive scanning of all rows, and it may be desired to complete 150 frames per second. In this circumstance, if the display has 96 rows of elements, then each scan must be completed within 1/(150×96) seconds, or within less than 70 microseconds (μS). At these speeds, the device's parasitic capacitances become very significant.

Normal Display Drive

Referring again to FIG. 2, further details are shown of a passive current-device matrix and drive system as used with embodiments described herein. Current sources such as the current source 270 are typically used to drive a predetermined known current through a selected pixel element such as the element 224. However, the applied current will not flow through an OLED element until the parasitic capacitance is first charged. When the row switch 228 is connected to ground to scan Row K, the entire column connection 274 must reach a requisite voltage to drive the desired current in element 224. That voltage may be, for example, about 6.5V, and is a value, which varies as a function of current, temperature, and time. The voltage on the column connection 274 will move from a starting value toward a steady-state value, but not faster than the current source 270 can charge the combined capacitance of all of the parasitic capacitances of the elements connected to the column connection 274. In one display, for example, there may be 96 rows, and thus 96 devices connected to each column 274. Each device may have a typical parasitic capacitance value of about 25 pF, for a total column parasitic capacitance of 2400 pF (96×25 pF). A typical value of current from current source 270 is 100 μA. Under these circumstances, the voltage will not rise from near zero faster than 100 μA/(96×25 pF), or 1/24 V/μS, and will change even more slowly as the LED begins to conduct. The result is that the current through the LED (as opposed to the parasitic capacitance) will rise very slowly, and may not achieve the target current by the end of the scan period. If the exemplary 96-row display operates at 150 frames per second, then each scan has a duration of not more than 1/(150×96) seconds, or less than about 70 μS. At a typical 100 μA drive current the voltage can charge at only about 42 mV per μS (when current begins to flow in the OLED, this charging rate will fall off). At 1/24 V/μS, the voltage would rise by no more than about 2.9 V during the scan period, which would not bring a column voltage from 0 to a nominal conduction voltage of 6.5V.

Since the current source 270, alone, will be unable to bring an OLED from zero volts to operating voltage during the entire scan period in the circumstance described above, a distinct "precharge" period may be set aside during which the voltage on each device is driven to a precharge voltage value Vpr. Vpr is ideally the voltage which causes the OLED to begin immediately at the voltage which it would develop at equilibrium when conducting the selected current. The precharge is preferably provided at a relatively low impedance in order to minimize the time needed to achieve Vpr.

Figure 3:
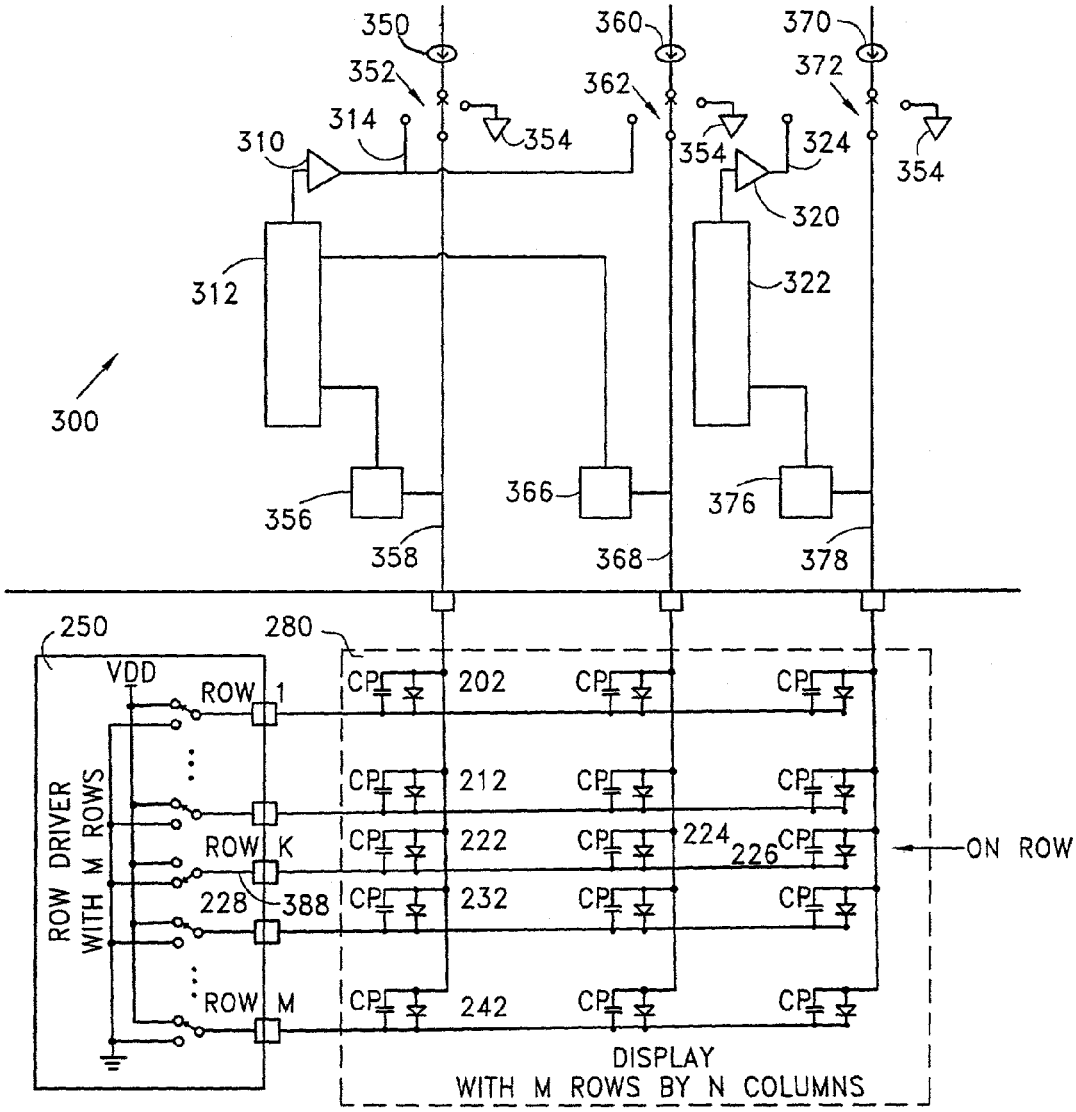
FIG. 3 is a schematic representation of elements for determining a precharge voltage.

FIG. 3 schematically illustrates control and sampling of the voltage at representative column connections 358, 368 and 378. For each column connection, a switch 352, 362 or 372 connects the column to various sources at appropriate times. For example, during a precharge period, each of the switches 352, 362 and 372 will connect the column to a precharge voltage source, such as 314 or 324. The figure is shown during an exposure period, when each switch 352, 362 and 372 connects each column (if active) to the corresponding known current source 350, 360 and 370. At the end of conduction period, the timing of which may vary between columns, the appropriate switch may connect the column to a column discharge potential 354, which may be ground or another known potential which is low enough to ensure rapid turn-off of the active elements.

Obtaining a Precharge Voltage

FIG. 3 illustrates with a simplified schematic how the precharge voltage may be obtained. First, a device conduction voltage may be sampled to obtain a sampled conduction voltage Vcs; column voltages available in the driver are convenient sources for such conduction voltages. Next, one or more Vcs quantities may be used to affect or determine the precharge voltage. Once determined, the precharge voltage is applied to an element by applying the precharge voltage onto the column. For the following scan cycle, the previously determined precharge voltage is applied to the column and a subsequent precharge voltage is determined based in part on the conduction voltage sampled during the scan cycle.

The voltage of any of the column connections, e.g., 358, 368 and 378, may be sampled by sampling circuit 356, 366 and 376 respectively, to obtain a Vcs. The voltage of the column connections, 358, 368, and 378, may be sampled during a portion of a conduction period of an element 222 when a selected current is driven through the element 222. The voltage of column 358, for example, includes the voltage produced on an element 222 (which is shown, as in FIG. 2, with both diode aspect and parasitic capacitance "CP"), as driven by a current source 350 in a column driver circuit 300. The cathode side of the element 222 is connected to ground through the row driver switch 228. The voltage developed at the column connection 358 includes the current provided by the current source 350 times that portion of a resistance of the column trace between the connection 358 and the element 222. Moreover, it includes the voltage produced by the common row impedance of the display 280 between the element 222 and a row K connection 388, as well as the driver impedance from the row K connection 388, through the switch 228, to ground, due to combined currents from the element 222 plus other conducting elements, e.g., 224 and 226. Thus, the Vcs from column 358 reflects other conduction voltages as well as that developed across the element 222 by the column current source 350. A Vcs may analogously be obtained from another column connection, such as 368 or 378, or from other columns (not shown) as explained in more detail subsequently.

Column voltages, such as at the shown column connections 358, 368 and 378, are described in particular embodiments herein for both sampling and precharging. However, other conduction voltages may usefully be sampled and/or controlled. For example, the voltage between column connections, e.g., 358, and row connections, e.g., 388, may be sampled, particularly if the row driver circuit 250 is within the same integrated circuit as the column driver 300.

The one or more Vcs samples obtained will be employed to affect or control a precharge voltage. For example, the Vcs from the sample device 376 may be transferred directly to a hold device 322, and then applied directly to a buffer 320 which provides a precharge voltage 324 for precharging the column through the switch 372. If the sample device provides a digital representation, then the hold device 322 may receive and convert such digital representation to a voltage to input to the buffer 320. The same effect may be provided analogically if the hold device 322 buffers the Vcs from the sample device 376, and charges a hold capacitor in the hold device 322 to a hold voltage Vh, which directly controls the buffer 320.

More than one Vcs may be used to control a precharge voltage. For example, the hold device 322 may combine an incoming Vcs with previous Vcs voltages to obtain a smoothed hold voltage Vh to apply to the buffer 320. As another example, a hold device 312 may combine Vcs from a plurality of sample devices, e.g., 356 and 366, to provide an input to a buffer 310 for providing a precharge voltage 314. Thus, the hold device 312 may operate as a sample combining device. The hold circuit 312 may combine not only the plurality of Vcs inputs with each other, but with previous voltages as well. As shown, the precharge voltage 314 output from the buffer 310 is provided, via a respective switch 352 or 362, to the same columns which provide the source for the Vcs upon which the precharge voltage is based. However, it should be noted that the columns which are precharged with a particular precharge voltage, e.g. 314, are typically not limited to those columns, e.g. 358 and 368, from which Vcs is obtained to affect the precharge voltage.

Precharge voltages may be based upon Vcs using any storage and/or combination techniques, for example either digital or analog techniques. A precharge level setting circuit may be comprised of the hold device 312 in conjunction with the buffer 310. If the sample devices 356, 366 and 376, in a digital example, are ADCs providing a digital output, then the hold devices 312 and 322 (or buffers 310 and 320) will typically include a DAC to convert the outputs from the sample devices into analog form, with or without further manipulation of the values. Such digital embodiments are well known in the art, and can be provided by the skilled person. An example of an analog embodiment for combining and storing Vcs values to provide precharge voltage is illustrated in FIG. 4.

Figure 4:
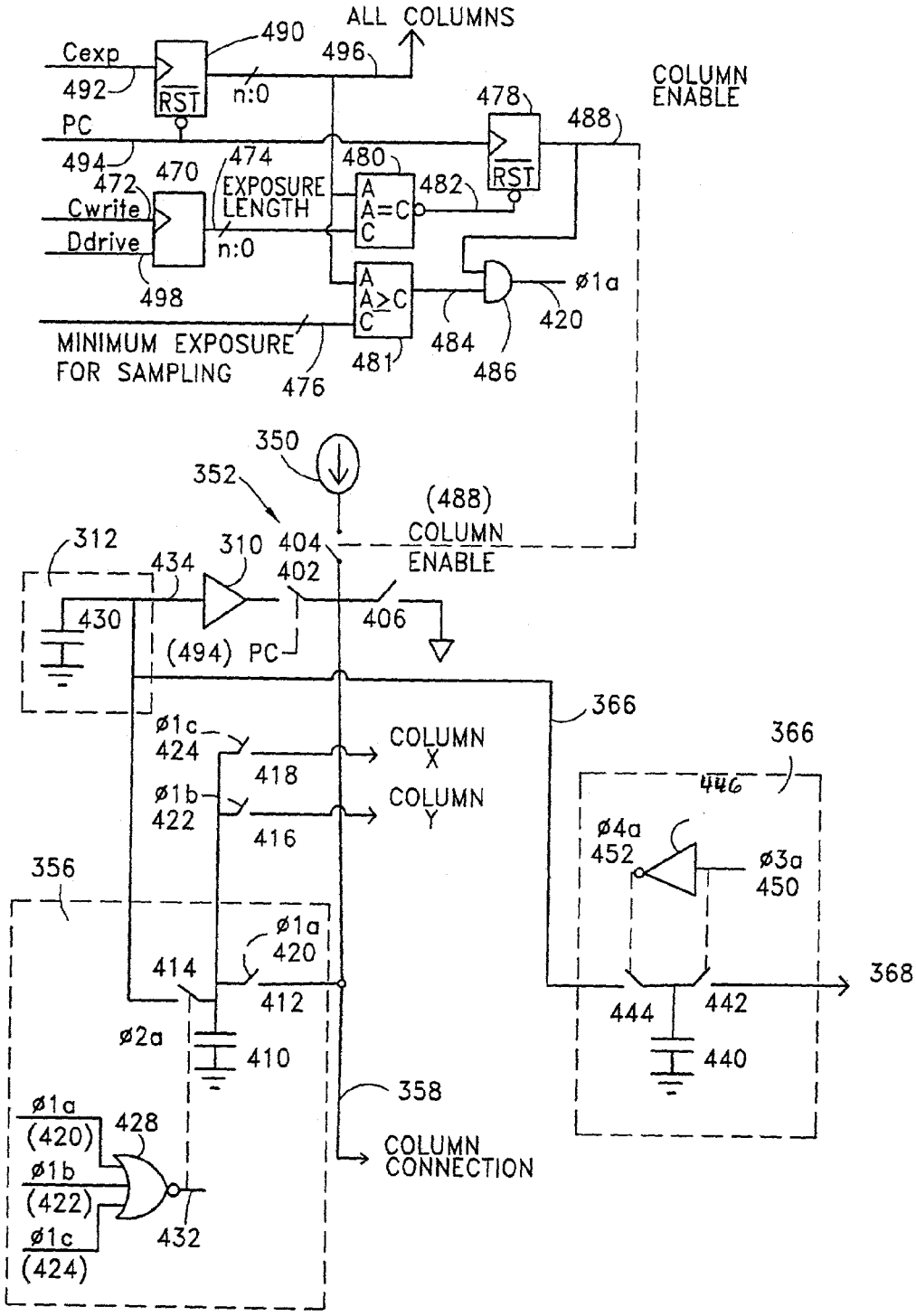
FIG. 4 is a simplified schematic diagram for determining a precharge voltage and setting an element exposure length.

FIG. 4 is a simplified, representative schematic of some aspects of an analog device embodiment of a column driver such as the driver circuit 300 of FIG. 3. One simplification represents electronic switches by a mechanical switch symbol, with a dotted line to a signal controlling the switch. A true, e.g. "1", value of the control logic closes the switch. The mechanical representation of the switch may imply some logic to preclude overlapping connections in a multiple-throw switch, such as the switch 352. The level shifting and logic needed to cause such electronic switches to function in accordance with the mechanical representation are well known in the art, and will be readily implemented by the skilled person.

FIG. 4 illustrates, with sample circuits 356 and 366, two techniques for sampling a variety of column voltages. Sample circuit 366 illustrates use of a single sample circuit 366 with a corresponding single column connection 368. An alternative technique is illustrated with respect to sample circuit 356. The sample circuits 356 and 366 operate as display conduction voltage sensing circuits. The circuits store a conduction voltage sample.

Sample circuit 356 in FIG. 4 shows additional details whereby a plurality of different columns, such as X, Y and the column connection 358, may be selectively sampled by the single sample device 356 in a manner which is not explicitly shown in FIG. 3. The sample circuit 356 includes logic such as the NOR gate 428, and extra sample switches such as 416 and 418 to connect to other columns X or Y. FIG. 4 thus illustrates an embodiment in which both techniques are used with different columns, but, of course, a given design may utilize only the technique illustrated with the sample circuit 356, only the technique illustrated with the sample circuit 366, or a technique of another design.

In the technique illustrated with sample device 366, each separate sample capacitor 440 is connected via a switch 442 to just one column connection 368 under control of a sample switch control signal Φ3*a* 450. A sample output switch 444 may be provided to connect the sample capacitor 440 to the hold device 312 under control of a second phase control signal Φ4*a* 452, which may be true whenever Φ3*a* is not true, as represented by an inverter 446. Φ3*a* and Φ4*a* may in general be false at the same time.

In the technique illustrated with sample device 356, a sample capacitor 410 may be used for sampling voltage on a plurality of column connections. A sample output switch 414 may also be provided to connect the sample capacitor 410 to the hold device 312. The output switch 414 is controlled by a second phase logic signal Φ2*a* 432, and will typically be open whenever another switch is closed to the sample device 356, particularly input switches such as 412, 416 and 418. Thus, when the sample capacitor 410 in the sample device 356 includes switches, 416 or 418, to sample extra columns Y or X, the control signal Φ2*a* 432 is preferably true only when all of the sample switch control signals Φ1*a* 420, Φ1*b* 422 and Φ1*c* 424 are false. The representative NOR gate 428 implementing this function preferably includes non-overlap logic, such that the switches connected to the sample capacitor 410 are closed only at mutually exclusively times.

The hold device 312 is shown as including a hold capacitor 430, and provides an output hold voltage Vh at a hold output connection 434 which is connected to the buffer 310. The hold device 312 may accept inputs from a plurality of sample circuits, as shown, via the sample output switch 414 for the Vcs on the sample device 356, and via the sample output switch 444 for the Vcs on the sample device 366. More such sample devices may also be connected. Thus, present values from sample circuits such as 356 and 366 may be combined with each other, and/or combined with previous Vcs values, to achieve a hold voltage Vh at connection 434 for input to the precharge voltage buffer 310. The hold device 312 operates as a precharge control circuit to establish a precharge voltage based on the element conduction voltage, which may be combined with other display element conduction voltages. The precharge voltage determined in the hold device 312 is provided to the voltage buffer 310.

The precharge voltage buffer 310 may provide a precharge voltage Vpr for one or more corresponding columns. The voltage buffer 310 operates as a precharge output circuit. Previous values of Vcs are typically combined in a Vh, but if temporal averaging is not desired then it may be avoided, for example, by making the hold capacitor 430 small compared to the sum of sample capacitors, e.g., 410 and 440, which are connected to it. The sample output switches, such as 414 and 444, which provide switchable connection of a plurality of sample devices to a hold device such as 312, may be closed simultaneously.

Particular embodiments may also employ just a single sample device, such as the sample device 356, with a particular hold device such as 312, in which case combining of a plurality of sample values is not necessary. Such an embodiment may be convenient when all columns to be sampled for determining the precharge voltage from a particular buffer (such as the buffer 310) are switchably connected to the single sample device, e.g. via switches such as 412, 416 and 418.

Consistent with the above description, then, at least three different approaches may be used to obtain, and/or to combine, conduction voltage samples Vcs from any or all of the elements of a matrix, depending upon the needs of a particular design. In a first approach, which may be termed non-concurrent sampling, each column connection to be sensed may be switchably connectable to a sample device, which may be shared by all such sampled columns.

In non-concurrent sampling, a conduction voltage is sampled for a single selected device at any one time, typically during a scan cycle conduction period, and the sample device is then connected to the hold element during a non-conduction period. Thus, in non-concurrent sampling, a conduction voltage is stored in a first stage capacitor, such as the sample capacitor 410, during a portion of the conduction period. The portion of the conduction period may be substantially all of the conduction period or may be all of the conduction period following an initial portion that may represent the transient settling period. The voltage from the first stage capacitor is electrically connected to a second stage capacitor, such as the hold capacitor 430, following the conduction period. The two capacitors may be connected for substantially all of the time that the sample capacitor is not connected to the column. Such sampling may be performed during successive scan cycles, so that previously sampled voltages are combined with the most recently sampled voltage to produce the hold voltage Vh on the hold capacitor. A plurality of conduction voltage samples may then be averaged. The extent of averaging will, of course, be a function of the relative size of the sample capacitor 410 and the hold capacitor 430. The averaging occurs during a non-conduction period when the sample capacitor 410 is connected to the hold capacitor 430. If the sample device performs digital sampling, or digital values are derived, then the combining function may be programmably controlled and great flexibility is possible. The sampled conduction voltages may be averaged, weighted averaged, filtered, or combined using some other method. For example, combined values from any selected groups of elements may be used to determine the precharge voltage.

A second approach to obtain and combine conduction voltage samples Vcs may be called parallel sampling. Each column connection which may be sensed may be connected by a sample switch, such as 442, to a unique corresponding sample capacitor, such as 440. In this approach, the outputs from a plurality of sample devices, such as the sample devices 356 and 366, are connected to a shared hold device, such as the hold device 312. There may be one or more separate hold devices like 312, each connected in turn to one or more sample devices, and each providing a precharge voltage reference to a buffer such as 310, the output of which provides precharge voltage to one or more column connections, such as 358 and 368. Thus, this approach can readily provide a plurality of different precharge voltages for a corresponding plurality of distinct column groups. In an extreme case for this arrangement, all of the sample devices, e.g. 366, for all of the sensed columns are connected via corresponding sample output switches, e.g. switch 444, to a single hold device, e.g. 312. The hold device thereby provides a single hold voltage Vh to a buffer, e.g. 310, as a reference for a precharge voltage.

A third approach to obtain and combine conduction voltage samples Vcs may be called mixed sampling. The mixed sampling approach can also provide one or more precharge voltages Vpc for one or more corresponding groups of columns, as does the second or parallel sampling approach. According to the third approach, a plurality of columns, such as Column X, Column Y and the column connection 358, is each switchably connected to a shared sample device, e.g. 356, via sample switches such as 412, 416 or 418. It will typically be inconvenient to connect different active columns together, which may be avoided by ensuring that only one of such common-capacitor sample switches is closed at any given instant. For example, just one of the columns may be connected during a particular conduction period. A plurality of columns may alternatively be connected to the sample capacitor at different times during a scan conduction period, particularly if the sample capacitor, e.g. 410, is connected to the hold circuit, e.g. via the switch 414, while all columns are disconnected. Such shared sample devices, e.g. 356, are typically connected via a corresponding sample output switch, such as 414, to a common hold device, such as 312, or to a digital conversion circuit. One or more sample devices, whether shared like 356, or unique to a column like 366, may be connected to a common hold device, such as 312, such that the held value can reflect the column voltages sampled by such one or more sample devices. A driver device, e.g. 300, may have just one such hold device to provide Vh for controlling Vpr for all columns, or it may include a plurality of such hold devices. If a plurality of hold devices is used, then each hold device may control a Vpr for a corresponding group or a plurality of columns. Voltage values from a plurality of hold devices may also be further combined. For example, a plurality of hold device voltages may be combined into a further combination stage (not shown), or after digital conversion they may be combined programmatically.

The hold voltage Vh, which is used to establish the next precharge voltage, may be filtered. Vh may be based only on combinations of presently sampled Vcs values, but will more typically combine Vcs values from previous scan cycles to form a smoothed precharge voltage. In digital embodiments, Vh may be filtered digitally to reflect any combination of Vcs samples from present and past scan cycles. In the analog embodiments represented in FIG. 4, filtering may be controlled by the number of sample device outputs combined into a particular hold device. For example, if four sample devices like 356, each having a sample capacitor 410 of the same value, are connected into a hold device 312 having a hold capacitor 430, then filtering generally occurs as a well-known averaging function of the relative capacitor values. In one embodiment, each sample device includes a second phase switch, such as the switch 414 or the switch 444, and all of the second phase switches are closed during a non-conduction period of the sampled elements. Accordingly, the resulting hold voltage Vh will be determined by the previous Vh value in combination with an average, Vcsa, of the four sampled Vcs values. Given a sum of all the sample and hold capacitor values Csum, including a sum of the sample capacitors Csamp and a hold capacitor value Chold, the new Vh (Vh(z+1)) will be the old Vh (Vh(z)) combined with Vcsa. In particular, $$Vh(z+1)=Vh(z)[Chold/Csum]+Vcsa[Csamp/Csum] \quad \text{(Eqn. 1)}$$

Thus, in this case a proportion Chold/Csum of the new Vh is due to the old Vh, and a proportion Csamp/Csum of the new Vh is due to the present Vcsa. If Csamp/Csum is more than about 25%, Vh will substantially track the recent Vcsa, and thus the precharge voltage will substantially track changes in the precharge voltage due to the varying column resistance seen by the different rows. Conversely, if Csamp/Csum is substantially smaller than 25%, the present Vcs will have less effect on the next Vh, and the precharge voltage will be less able to follow changes in Vcs from row to row. For long term averaging, Chold may be about 20 to 200 times Csamp. For rapid tracking, Chold may be about 0.3 to 3 times Csamp. Values between or outside these ranges may also be used, depending upon the application.

As an example, if four sample devices each having a 1 pF sample capacitor are combined into a hold device having a hold capacitor of 8 pF, the next Vh would be based 33% upon the present average of Vcs values. Thus, the precharge voltage would substantially track progressive changes in conduction voltages from row to row.

It may be desirable to individually control an exposure time for each device in a matrix by providing an exposure period of variable duration for each column during each scan cycle. The devices shown in FIG. 4 to control such variable exposure durations are generally, but not necessarily, fabricated as part of the driver circuit 300.

A precharge signal PC 494 may be provided to reset a counter 490 during a precharge period that occurs prior to an exposure period. Upon termination of the precharge period, the PC signal 494 may set a latch 478 such that an output "Column Enable" 488 enables a switch 404 to allow the current source 350 to provide column exposure current to the column connection 358. The precharge signal PC 494 may be provided for the entire chip, or may be established for a group of one or more columns.

In order to control the termination of exposure current, exposure duration information may cause reset of the latch 478. An exposure clock Cexp 492 may be provided, the period of which determines the minimum exposure period. The counter 490 may count the exposure clock edges and output bits representing a current exposure count 496 to some or all of the column driver circuits. The counter 490 of FIG. 4 is shown to output n+1 bits. The exposure count 496 may be provided to all columns, or alternatively some columns may generate separate exposure counts. Particularly when provided to many or all columns, such exposure count need not be uniform, but may provide a varying time between successive exposure counts to provide varying steps between exposure levels without a need for excessive data bits to represent such exposure levels. The exposure count 496 may be applied to input "A" of a logic circuit 480.

Exposure drive data Ddrive 498 may be provided for the particular column, e.g., 358, to a register 470. The Ddrive data 498 may be provided serially and shifted into a shift register 470, or may be provided on a parallel bus and be latched into the register 470 under control of a write clock Cwrite 472. The Ddrive data 498 is typically represented using the same number of bits as the exposure count 496. The output 474 of the register 470 may be n+1 bits of parallel exposure length data, which may then be provided to input "B" of the logic circuit 480. The logic circuit 480 may compare the exposure length data 474 on input "B" with the current exposure count value 496 on input "A" and provide an output 482 which, when A and B are equal, resets the latch 478. The "Column Enable" signal 488 is thus negated, and will cause the exposure current switch 404 to open and also, typically, will initiate discharge of the controlled column, e.g. 358, through discharge circuitry such as a column discharge switch 406.

An output 420 of an AND gate 486 may be the signal Φ1*a* 420 to control the sample switch 412. A logic device 481 may provide further logic for controlling the signal Φ1*a* 420. The logic device 481 may be employed to preclude sampling a column which has a conduction period shorter than the minimum exposure value 476. The configuration may prevent connection of a Vcol to a sample capacitor until the end of the minimum exposure period, thus permitting some settling of Vcol. Alternatively, the configuration may prevent connection of a Vcol to a sample capacitor until the end of a transient settling period. The initial transient settling period is typically less than 25% of the scan cycle. To effect this delay, the value of minimum exposure for sampling 476, typically represented by less than (n+1) bits, may be provided to a "C" input of the device 481 and the Exposure Count value 496 is provided to an input "A" of the logic device 481. The logic device 481 provides an output 484 that is true only when the Exposure Count value 496 is at least as great as the value of minimum exposure for sampling 476. Signal Φ1*a* 420 may be prevented, until such time, from causing the column 358 to be connected to the sample device 356. The input "C" may be hardwired, or made selectable. Minimum sampling exposure may alternatively be controlled by a minimum exposure signal that is low until a selected period after the end of the precharge signal PC 494. Such a control line may be provided directly to a plurality of column control circuits, and may be connected to the input 484 of the AND gate 486 without any need for the logic device 481. In general, an almost unlimited variety of electronic device arrangements and logic may be employed to control a column drive device as taught herein.

The sample switch control output Φ1*a* 420 is true only if the column enable 488 is true and the minimum exposure period has been satisfied, as indicated by the AND gate 486 which provides Φ1*a* 420. The column enable output 488 controls the switch 404 which connects the current source 350 to the column connection 358, and thus directly controls the exposure time. The column enable 488 is set at the end of the precharge period, and is reset when the exposure count 496 "A" is equal to the selected exposure length "B."

Control for the column discharge switch 406 is not shown. The switch 406 is preferably closed after the end of the column enable 488, as long as the precharge switch 402 is not closed. In view of the substantial parasitic capacitance of the columns when the rows are connected to an AC ground, the actual termination of conduction by the matrix element may be controlled by the column discharge switch. In such case, the exposure switch 404 may be opened either somewhat before or somewhat after the discharge switch is closed, though typically the transitions will be nearly concurrent.

A selectable column sample group is a plurality of columns which are connectable to a shared sample device (such as the sample device 356) via a corresponding plurality of first phase switches (such as 412, 416 and 418). In the typical low-impedance circuits, such samples are typically separated by time. A single member of such selectable column sample group may be selected during a particular scan cycle, for example that column of the group which has the longest exposure time, i.e. the column for which the exposure length value, e.g. 474, is largest. Alternatively, however, differences in exposure times between selectable column sample group members may be utilized to permit sampling voltages from a plurality of such selectable columns during a single exposure period. One implementation of this alternative selects, first, the shortest exposure length value that exceeds a minimum value. At the end of exposure for this first-selected column, the corresponding first phase switch may be opened and the second phase switch, e.g. 414, closed to the hold device 312. After sufficient settling time, the second phase switch 414 may be opened and another first phase switch closed to a column having an exposure time sufficiently long to permit establishing an accurate sample voltage on the sample device, e.g. 410. This time-multiplex process may be repeated several times during a scan cycle to average a plurality of different Vcs values using a single sample device. It may be performed as a variation of the first "non-concurrent" sampling approach, or as a variation of the third "mixed" sampling approach, both of which are discussed above.

Applying Precharge in Normal Operation

The stored value Vh on a hold device is used at least in part as a basis for precharging the parasitic capacitance of columns to a precharge voltage Vpr at the beginning of exposures, as shown in FIG. 4. In particular, a buffer such as the buffer 310 provides a precharge voltage Vpr at relatively low impedance to one or more columns, e.g. the columns 358 and 368 of FIG. 3. Vpr may be simply the value of Vh, or may be adjusted with an offset voltage (not shown) to provide an adjusted Vpr for the particular column or columns. For example, some elements will have more column and/or row resistance to the drivers than other elements. The different voltage losses due to the connection resistances may be measured or predicted, and based upon the selected current and Vpr difference may readily be calculated. The Vpr used may then be adjusted for the calculated difference.

Returning to FIG. 3, at the beginning of a scan period for Row K, a switch 362 in the column driver circuit 300 connects the column connection 368 to the Vpr 314 output from the buffer 310. Thus, during a precharge period at the beginning of the scan, the column connection 368 is driven from the relatively low impedance of the buffer 310. Each of the parasitic capacitors (CPs) of all of the elements connected to column 368 is thus charged quickly to Vpr.

It should be noted that a single precharge voltage buffer, such as 310, may be used for many columns or even all of the columns of the driver 300, such that precharge buffer impedance becomes an important issue. In such case it is advantageous to provide a capacitor from Vpr to ground, the capacitor having a value of about one hundred or more times the parasitic capacitance of all of the columns which the driver 300 drives.

The duration of the precharge period depends upon several factors. Each selected column has a parasitic capacitance and a distributed resistance which affects the time required to achieve the full voltage on the driven element. Moreover, the precharge buffers have certain impedances, which are common to the number of elements they are driving, and their effective impedance will therefore vary. For example, if all of the elements in a row are selected, then the load seen by the buffer 310 during precharge may include many parallel column loads. A typical 96 row, 120 column device might have a column resistance of about 1 K ohms, and a parasitic capacitance of about 2400 pF. The precharge time constant ($\tau$) in this case will be greater than about 2.4 μS. To avoid significantly raising this $\tau$, the impedance of the buffer 310 is preferably not more than 300 ohms divided by the number of columns connected to the particular buffer. Generally, given a precharge time constant $\tau$, it is preferred to continue precharge for about three times the length of $\tau$, or in the present example about 7 μS.

At the end of the precharge period and the beginning of an exposure period for Row K 388, a row switch 228 connects Row K 388 to ground. The element 224 connected to the Row K 388 is directed to conduct during this scan. Also at the end of the precharge period, the column drive switches, e.g. 362 and 372, of the selected elements, e.g. elements 224 and 226, may switch each selected column connection, e.g. 368 and 378, to the column current sources, e.g. current sources 360 and 370, respectively, for the remainder of an exposure period for the selected elements. The skilled person will understand that any or all of the elements, e.g. 222, 224, 226, of a scanned row, e.g. Row K 388, may generally be selected during the scan of that row.

Each individual element may generally be turned off at a different time during the scan of the element's row, permitting time-based control of the output of each element. At the end of an exposure time for a particular element, e.g. 224, the column connection, e.g. 368, may be disconnected from the current source, e.g. 470, and reconnected to a column discharge potential 354, which may be ground, so as to rapidly turn off the element. At the end of the exposure time for the last element remaining "on" in a scanned row, the row switch, e.g. 228, in the scan circuit row driver 250 may connect the row connection, e.g. 388, to a supply, such as Vdd. This is generally done at least by the beginning of the precharge period, in order to prevent conduction during the precharge period because the precharge period is typically exclusive of the conduction period. However, it is possible to perform exposure during the precharge period, in which event the row switch for the selected column would be grounded.

Examples of Alternatives and Extensions

While the above detailed description has shown, described, and pointed out novel features of the invention as applied to various embodiments, the skilled person will be understood that various omissions, substitutions, and changes in the form and details of the device or process illustrated may be made without departing from the scope of the invention. For example, those skilled in the art will understand that the orientation of devices in the display matrix is a matter of design convenience, and the choice of which connections to call rows, and to scan, and which to call columns, is also design convenience. The skilled person will readily be able to adapt the details described herein to a system having different devices, different polarities of devices, and/or different row and column architectures, and can appreciate that such alternative systems are implicitly described by extension from the detailed description above.

Variations such as these are contemplated as alternative embodiments of the invention. Therefore, the scope of the invention is indicated by the appended claims rather than by the foregoing description. All changes which come within the meaning and range of equivalency of the claims are to be embraced within their scope.

What is claimed is:

1. A precharge device for a display, comprising:

a sampling circuit configured to sample a conduction voltage of a plurality of elements of the display;

a hold circuit coupled to the sampling circuit, configured to store a plurality of sampled conduction voltage values and to generate a precharge voltage based at least in part on an average of the stored plurality of sampled conduction voltages; and a buffer coupled to the hold circuit, configured to provide the precharge voltage output.

2. The precharge device of claim 1, wherein the sampling circuit samples the plurality of conduction voltage during a portion of a conduction period wherein a selected current is driven through the element.

3. The precharge device of claim 2, wherein the portion of the conduction period is substantially all of the conduction period following a transient settling period.

4. The precharge device of claim 1, wherein the sampling circuit comprises:

a sample capacitor; and a sample output switch configured to selectively couple the sample capacitor to the hold circuit.

5. The precharge device of claim 4, wherein the sample circuit further comprises a plurality of sample input switches to selectively control the sample capacitor to sample a corresponding plurality of conduction voltages of a corresponding plurality of elements of the display matrix.

6. The precharge device of claim 5, wherein the plurality of sample input switches are each closed for a variable exposure time.

7. The precharge device of claim 4, wherein the hold circuit comprises a hold capacitor.

8. The precharge device of claim 1, further comprising a plurality of additional sampling circuits, each of the additional sampling circuits configured to sample a corresponding conduction voltage of a corresponding device element of the display, and wherein the hold circuit is selectively coupled to the sample circuit and each of the additional sampling circuits.

9. The precharge device of claim 8, wherein the hold circuit averages the sampled conduction voltage values from the sample circuit and each of the additional sample circuits.

10. An apparatus for driving current in a display device having a plurality of display element each of which includes first and second terminal regions, the apparatus comprising:

a first current driver circuit connected to the first terminal region of the display element and configured to generate a first current;

a second driver circuit configured to connect the second terminal region of the display element to a known voltage source to accept the first current;

a precharge output circuit configured to output a precharge voltage to the display element;

a plurality of display conduction voltage sensing circuit configured to store a display conduction voltages developed when the display element conducts a predetermined current developed by a corresponding plurality of conducting display elements; and a precharge control circuit configured to establish the precharge voltage based upon the sensed element conduction voltage averaged with other display element conduction voltages.

11. The apparatus of claim 10, wherein at least some of the other display element conduction voltages were developed at an earlier time.

12. The apparatus of claim 11, further comprising a second sampling switch switchably connecting a different column connection of a different display element to the first sample storage capacitor.

13. The apparatus of claim 10, wherein at least some of the other display element conduction voltages are developed substantially concurrently with the sensed element conduction voltage.

14. The apparatus of claim 10, wherein the display conduction voltage sensing circuit includes a first sampling switch switchably connecting a column connection of the display element to a first sample storage capacitor.

15. The apparatus of claim 10, wherein the precharge control circuit includes a combination storage capacitor for storing a voltage reflecting the sensed element conduction voltage combined with other display element conduction voltages.

16. The apparatus of claim 15, further comprising a plurality of switchable connections between the combination storage capacitor and a corresponding plurality of sample storage capacitors.

17. A precharge level determination circuit for display elements, comprising:

a current source configured to provide a known current to a selected display element during a current conduction period of a scan cycle;

a sample circuit configured to sample a plurality of display conduction voltages during the current conduction period;

a sample combining circuit configured to average the plurality of sampled display conduction voltage of the current conduction period with a combined display conduction voltage of a previous current conduction period; and a precharge level setting circuit configured to set a precharge voltage level for display elements based upon the average display conduction voltage.

18. A display matrix having element precharge, comprising:

a sheet of emissive material;

a number, M, of row conductors disposed on a first side of the sheet of emissive material;

a number, N, of column conductors disposed on a second side of the emissive sheet opposite the rows, wherein a device element is formed where one row conductor overlies one column conductor such that M×N device elements are created;

a column driver having a drive circuit for each of the column conductors; a row driver having a plurality of switches to selectively couple each row connection to a first voltage potential or a second voltage potential; and a precharge device comprising:

a sampling circuit to sample a plurality of conduction voltages of a column conductor;

a hold circuit coupled to the sampling circuit, to store the plurality of sampled conduction voltage values and to generate a precharge voltage based at least in part on the average of the sampled conduction voltage; and a buffer coupled to the hold circuit, to apply the precharge voltage to the column conductor.

19. The display matrix of claim 18, wherein the sampling circuit samples the conduction voltage during a portion of a conduction period and the buffer applies the precharge voltage to the column conductor during a mutually exclusive precharge period.

20. A matrix display precharging device, comprising:

means for sampling a conduction voltage on an element;

means for storing a number of conduction voltage samples;

means for determining a precharge voltage based at least in part on an average of the stored plurality of sampled conduction voltages; and means for applying the precharge voltage to the element.

21. The precharging device of claim 20, wherein the conduction voltage is sampled during a portion of a conduction period of the element wherein a selected current is driven through the device element.

22. The precharging device of claim 21, wherein the conduction voltage is sampled during the portion of the conduction period following a transient settling period.

23. The precharging device of claim 22, wherein the means for applying the precharge voltage applies the precharge voltage during a precharge period that is exclusive of the conduction period.

24. The precharging device of claim 20, wherein the means for sampling the conduction voltage comprises:

means for storing the conduction voltage in a first stage capacitor during a portion of a conduction period; and means for coupling the voltage from the first stage capacitor to a second stage capacitor following the conduction period.

25. The precharging device of claim 20, further comprising means for averaging the sampled conduction voltage with previously sampled conduction voltage values.

26. The precharging device of claim 20, wherein:

the means for sampling the conduction voltage samples during a conduction period of the element; and the means for applying the precharge voltage applies the precharge voltage to the plurality of elements of the column during a precharge period that is exclusive of the conduction period.

27. An apparatus for establishing a precharge voltage for current-driven device elements in a matrix, comprising:

means for selecting a plurality of elements for sampling;

means for applying a previously established precharge voltage to the element during a precharge period of a scan cycle;

means for driving a selected current through the sampled element from a current source during a current conduction period of the scan cycle;

means for sampling a conduction voltage during the current conduction period of the scan cycle; and means for basing subsequent precharge voltages at least in part on an average of the sampled conduction voltage.

* * * * *